US007482797B2

(12) United States Patent
Cave

(10) Patent No.: US 7,482,797 B2
(45) Date of Patent: Jan. 27, 2009

(54) TRIMMABLE BANDGAP CIRCUIT

(75) Inventor: David Cave, Tempe, AZ (US)

(73) Assignee: Dolpan Audio, LLC, Dover, DE (US)

( * ) Notice: Subject to any disclaimer, the term of this patent is extended or adjusted under 35 U.S.C. 154(b) by 131 days.

(21) Appl. No.: 11/446,567

(22) Filed: Jun. 2, 2006

(65) Prior Publication Data

US 2007/0279030 A1 Dec. 6, 2007

(51) Int. Cl.
*G05F 3/20* (2006.01)

(52) U.S. Cl. ..... 323/313; 327/538

(58) Field of Classification Search ..... 323/312–316, 323/364, 222; 327/530–538, 539–543, 512, 327/513

See application file for complete search history.

(56) References Cited

U.S. PATENT DOCUMENTS 6,841,982 B2 * 1/2005 Tran ..... 323/316

* cited by examiner

*Primary Examiner*—Rajnikant B Patel
(74) *Attorney, Agent, or Firm*—Knobbe Martens Olson & Bear LLP

(57) ABSTRACT

A voltage bandgap circuit comprises a first transistor and a second transistor connected in a voltage bandgap circuit arrangement, the area of the first transistor is selected to be a predetermined multiple of the area of the second transistor; a differential input amplifier has a first input coupled to the first transistor and a second input coupled to the second transistor; the amplifier has its output coupled to an output node. A first trimmable resistance network is coupled to say the bandgap circuit and is trimmed to adjust the output voltage of the bandgap circuit based upon a single temperature voltage measurement made across two of the terminals of each transistor.

11 Claims, 6 Drawing Sheets

TRIMMABLE BANDGAP CIRCUIT

FIELD OF THE INVENTION

The present invention pertains to temperature sensing, in general, and to an improved bandgap circuit, in particular.

BACKGROUND OF THE INVENTION

To measure temperature a sensor converts the quantity to be measured to a voltage. Common solid state sensors utilize semiconductor diode Vbe, delta Vbe, or a MOS threshold to provide a temperature dependent output voltage. The temperature is determined from the voltage measurement. Once the sensor output is converted to a voltage it is compared it to a voltage reference. It is common to utilize a voltage source with a low temperature coefficient such as a bandgap circuit as the voltage reference. The bandgap voltage reference is about 1.2 volts. An n-bit analog to digital converter divides the bandgap reference down by $2^n$ and determines how many of these small pieces are needed to sum up to the converted voltage. The precision of the A/D output is no better than the bandgap precision of the bandgap reference.

Thus both the sensor, bandgap and the A/D converter determine accuracy.

Two problems occur in integrated bandgap circuits. Typical plots of the output bandgap voltage with respect to temperature are bowed and are therefore of reduced accuracy. Secondly, because of process variables, the output voltage of different bandgap circuits will vary from circuit to circuit at a single temperature. This variance adds a slope to the bow to the slope of the output voltage over temperature.

Many circuit techniques have been developed to reduce the slope and bow of the bandgap voltage as a function of temperature.

Distribution of the bandgap voltage at any given temperature has historically been corrected by adjusting the output voltage to a nominal value during the manufacturing process, typically by adjusting a resistor value.

SUMMARY OF THE INVENTION

In accordance with the principles of the invention, a voltage bandgap circuit includes a trimmable resistor network. The base-emitter voltage of a bipolar transistor of the bandgap circuit is measured. Based upon the measured base-emitter voltage, at a specific temperature, the resistor network is trimmed to provide a predetermined bandgap voltage at the specific temperature.

In the illustrative embodiment of the invention, a voltage bandgap circuit comprises a first transistor and a second transistor connected in a voltage bandgap circuit arrangement, the area of the first transistor is selected to be a predetermined multiple of the area of the second transistor; a differential input amplifier has a first input coupled to the first transistor and a second input coupled to the second transistor; the amplifier has its output coupled to an output node. A first trimmable resistance network is coupled to the bandgap circuit and is trimmed to adjust the output voltage of the bandgap circuit.

BRIEF DESCRIPTION OF THE DRAWING

The invention will be better understood from a reading of the following detailed description in conjunction with the drawing figures in which like reference designators identify like elements, and in which.

DETAILED DESCRIPTION

For a bipolar transistor in the forward active region, the first order equation for collector current related to Vbe can be approximated by:

$$Vbe=(kT/q)ln(Ic/AIs)$$

where,

T is temperature in Kelvin

A is an area scale $I_S$ is dark current for a unit area device (process dependent)

q is charge on the electron

K is Boltzman's constant

Two junctions operating at different current densities will have a different Vbe related by the natural logs of their current densities.

From this it can be shown that the slope of Vbe vs. temperature must depend on current density. Vbe has a negative temperature coefficient. However, the difference in Vbe, called the ΔVbe, has a positive temperature coefficient.

$$\Delta Vbe=Vbe|_1-Vbe|_A=(kT/q)\cdot[ln(I_1/I_S)-ln(I_2/AI_S)]$$

For equal currents ($I_1=I_2$) and an area scale of A $$\Delta Vbe=(kT/q)\cdot ln\ A$$

In the illustrative embodiment of the invention, a bandgap circuit is formed as part of a CMOS device of the type utilizing CMOS N-well process technology.

Figure 1:
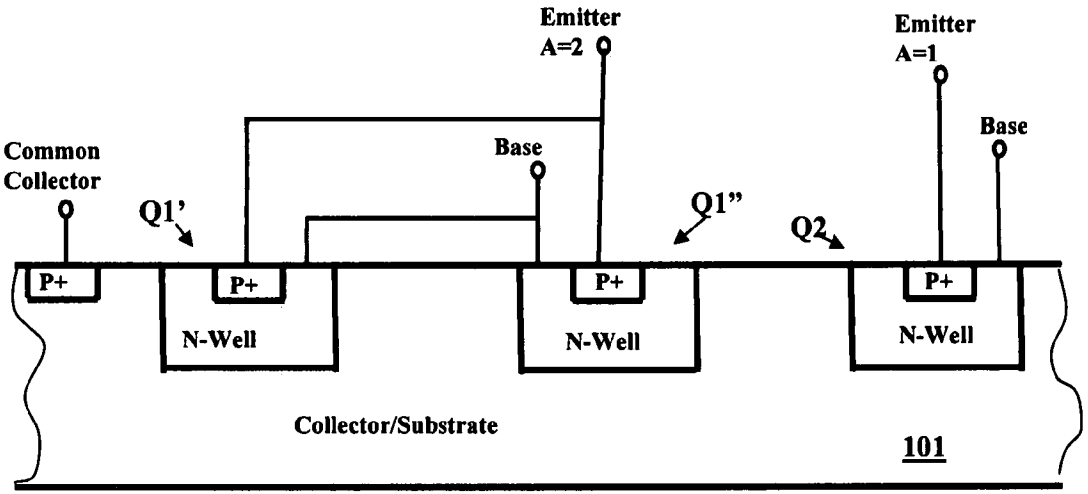
FIG. 1 illustrates a prior art CMOS N-well substrate having a bipolar transistor structure of a type utilizeable in a bandgap circuit.
Figure 2:
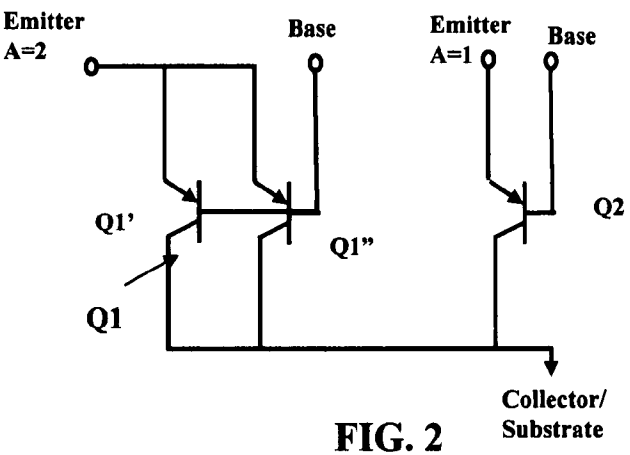
FIG. 2 is a schematic of the prior art bipolar structure of FIG. 1.

The most usable bipolar transistors available in the CMOS N-well process is the substrate PNP as shown in FIG. 1 in which a single transistor Q1 is formed by transistors Q1', Q1" which have a combined area ratio, A, that is twice that of the transistor Q2. The structure is shown in schematic form in FIG. 2. All the collectors of transistors Q1', Q1", Q2 are connected to the chip substrate 101, i.e., ground. There is direct electrical access to the base and emitter of each transistor Q1', Q1", Q2 to measure or control Vbe but there is no separate access to the collectors of the transistors Q1', Q1", Q2 to monitor or control collector current.

There are several general topologies based on the standard CMOS process and its substrate PNP that can be used to create a bandgap circuit.

Figure 3:
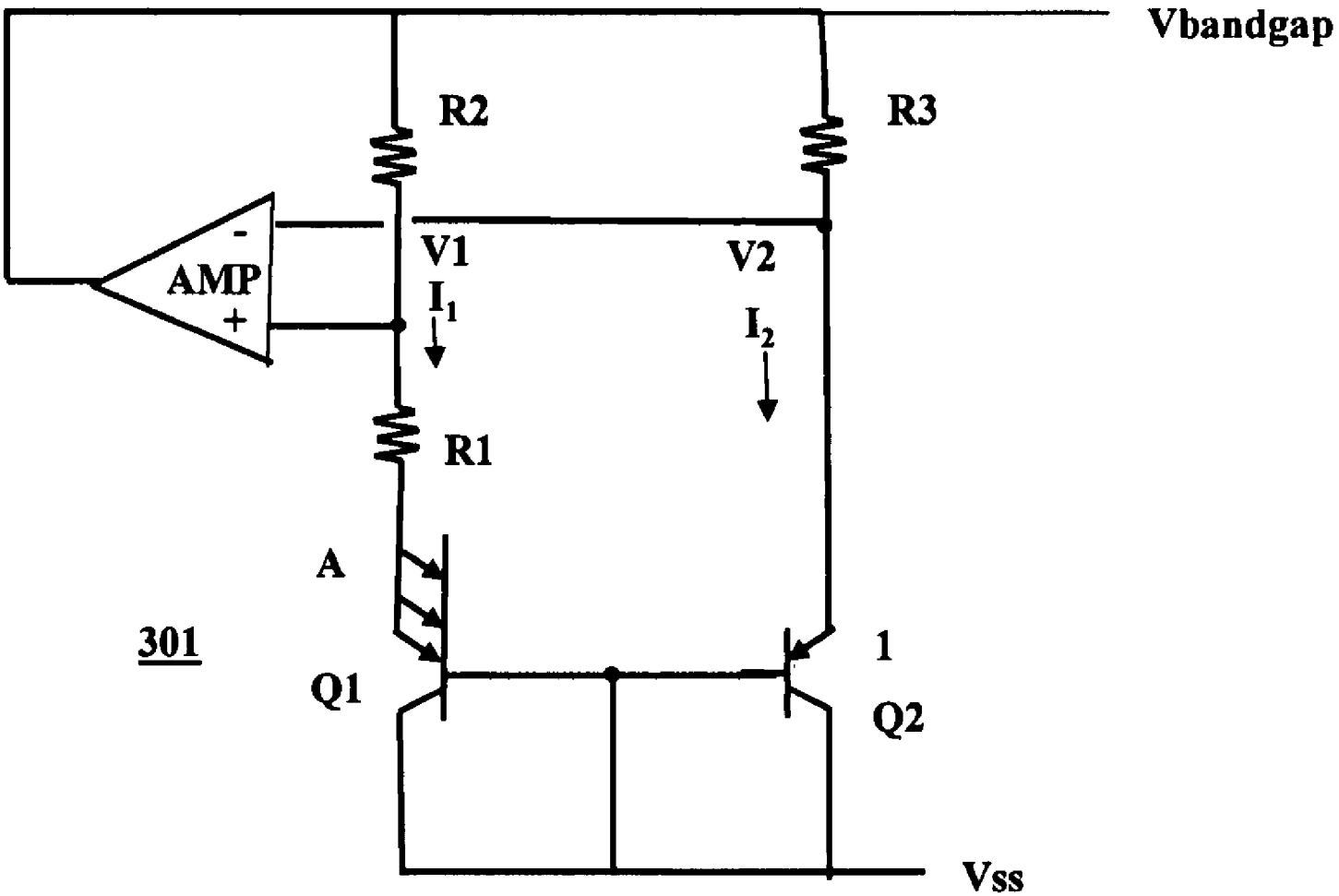
FIG. 3 is a schematic of a prior art bandgap circuit.

FIG. 3 illustrates a prior art bandgap circuit 301 architecture. Bandgap circuit 301 comprises a transistor Q1 and a transistor Q2. The area of transistor Q1 is selected to be a predetermined multiple A of the area of transistor Q2. First and second serially connected resistors R1, R2 are connected between an output node Vref and the emitter of transistor Q2. A third resistor R3 is connected in series between output node Vbandgap and the emitter of transistor Q1. A differential input amplifier AMP has a first input coupled to a first circuit node disposed between resistors R1, R2; and a second input coupled to a second node disposed between resistor R3 and the emitter of transistor Q1. Amplifier AMP has its output coupled to the output node Vbandgap.

Figure 4:
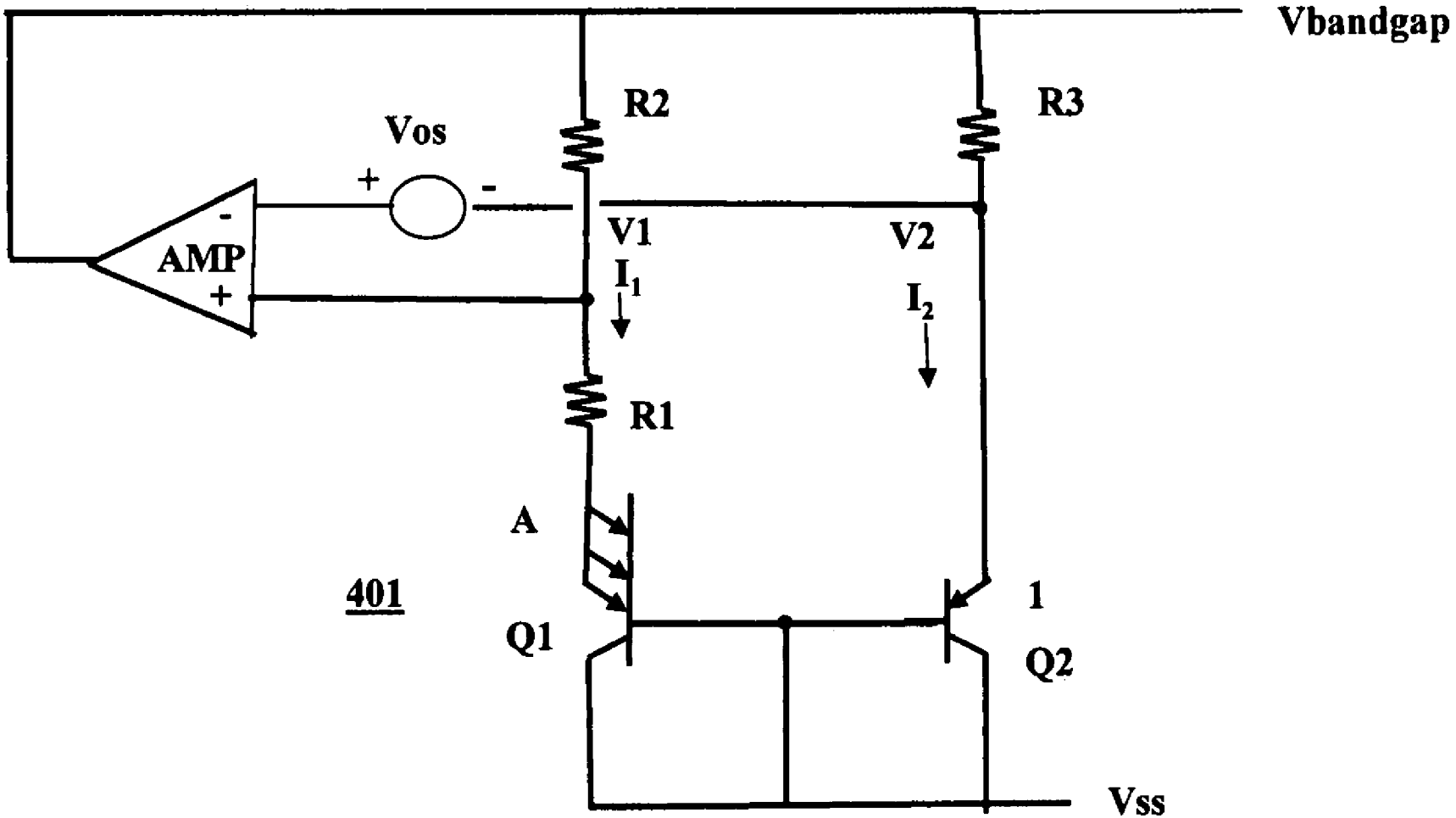
FIG. 4 is a schematic of the bandgap circuit of FIG. 3 with an offset voltage.

The circuit of FIG. 3 is enhanced by adding an input offset voltage Vos as shown by circuit 401 in FIG. 4. In analyzing circuit 401 it is appropriate to neglect less dominant terms such as PNP current gain (β), base resistance in the PNP, and amplifier gain.

When $R_2=R_3$, the current in each leg of the bandgap circuit 401 is:

$$I_1=I_2=kT/(q\,R_2)\ln A$$

The general form of Vbandgap is:

$$V\text{bandgap}=(kT/q)\ln(I_1/AI_S)+(1+R_2/R_1)(kT/q\cdot\ln A+Vos)$$

Which is represented as:

$$V\text{bandgap}=Vbe+m(\Delta Vbe+Vos)$$

Figure 5:
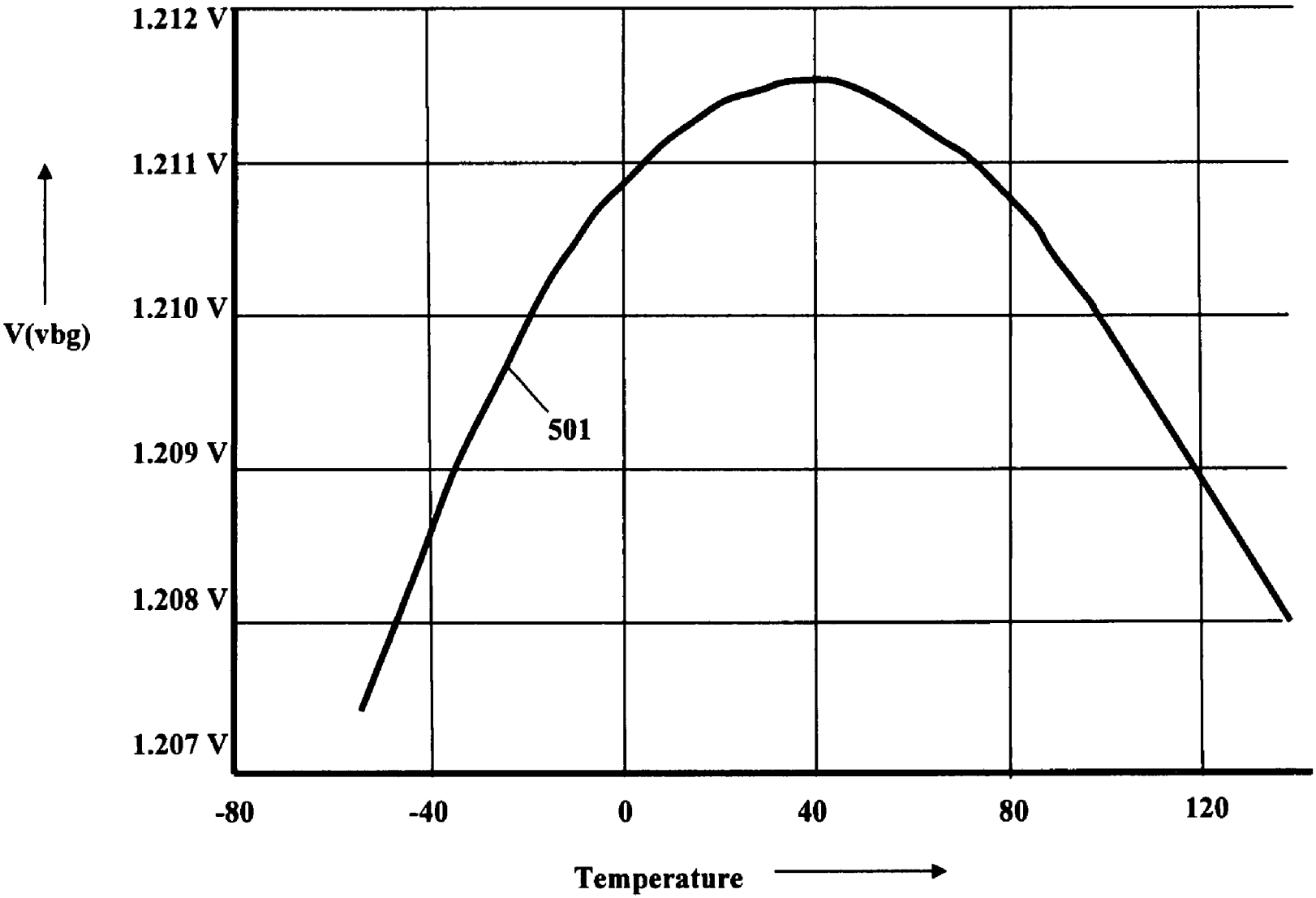
FIG. 5 is a typical plot of bandgap voltage versus temperature for the prior art circuit of FIGS. 3 and 4.

In this representation, Vbe (which is approximately 0.7 volts at room temperature) has a negative temperature coefficient (TC) of approximately −2.0 mV/° C. ΔVbe has a positive temperature coefficient that is much less than that of Vbe, but when gained up by m, $(1+R_2/R_1)$, the two tend to cancel. A properly chosen A (ΔVbe) and m for a given integrated circuit technology results in a low temperature coefficient Vbandgap as shown by curve 501 in FIG. 5.

Figure 6:
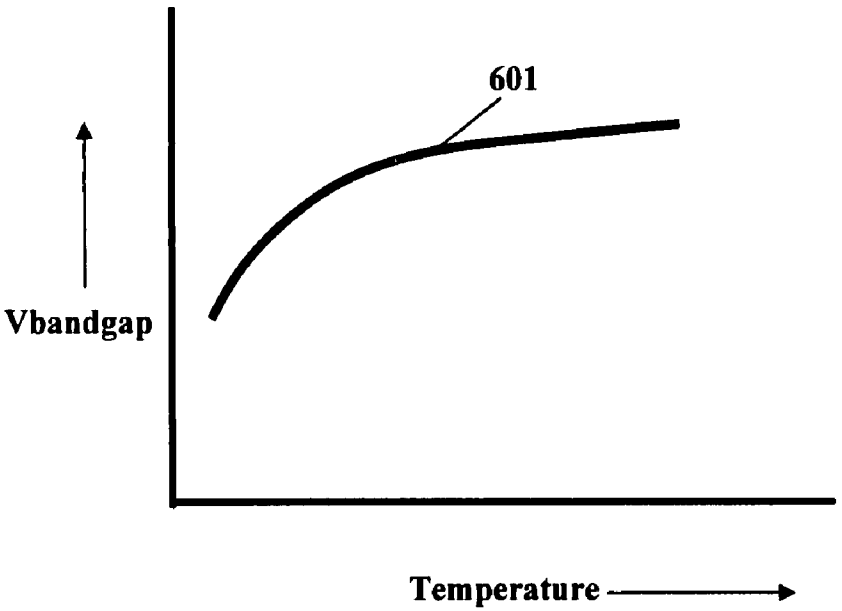
FIG. 6 is a plot of bandgap voltage versus temperature.

In early generation CMOS processes the most variable terms of bandgap voltage were the gain m, $(1+R_2/R_1)$, and amplifier offset voltage Vos. If m is too large, the positive TC of ΔVbe is larger than the negative TC of Vbe, resulting in a positive bandgap slope as shown by curve 601 shown in FIG. 6.

Figure 7:
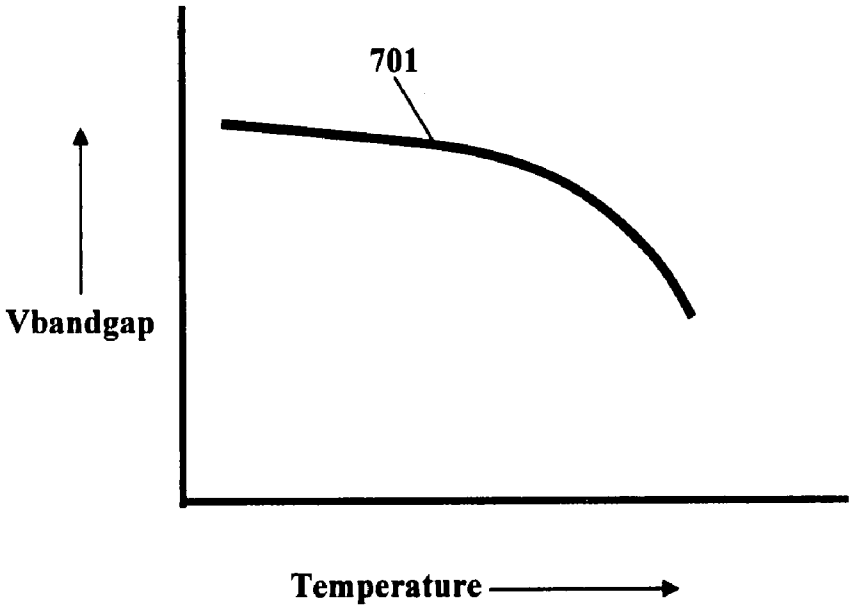
FIG. 7 is a plot of bandgap voltage versus temperature.

On the other hand, if m is too small, the bandgap voltage will have a negative slope as shown by curve 701 in FIG. 7.

Figure 8:
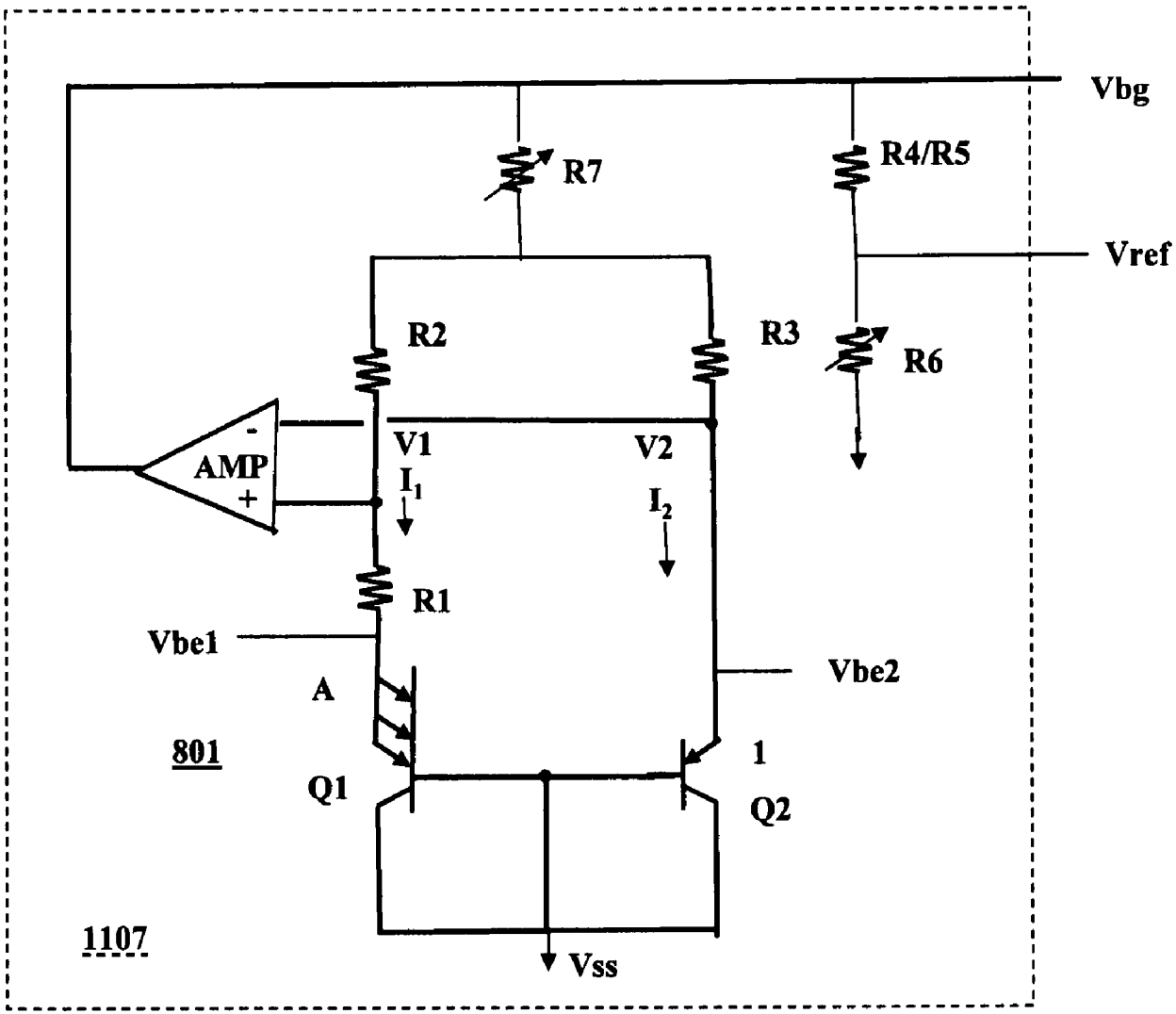
FIG. 8 is a schematic of a bandgap circuit in accordance with the principles of the invention.

FIG. 8 illustrates a circuit 801 in accordance with the principles of the invention. A small portion of resistance R2 and R3 of the circuit of FIG. 3 are combined into a resistance R7 in circuit 801 of FIG. 8.

In the past, where m and Vos have been the dominant variables in the bandgap voltage, a low TC was achieved by measuring the bandgap voltage at a given temperature and comparing that value to a nominal value. If the bandgap voltage measured low, it would have a negative TC as in FIG. 7 and R1, R2, or R7 were adjusted.

In modern integrated circuit processes, control of R1, R2, and R7 have become more precise and circuit techniques have been developed such that the second term of the bandgap voltage equation, i.e., m(ΔVbe+Vos) has a much tighter distribution than the first term, i.e., Vbe. In integrated circuits utilizing modern process, if the bandgap voltage is high at a given temperature, it is most likely due to a high Vbe rather than a large m.

The nominal low TC bandgap voltage is more dependant on the Vbe term than on the m(ΔVbe+Vos) term and traditional trim techniques result in poor temperature performance of the bandgap circuit.

The nominal voltage for a low TC bandgap circuit is therefore related to the bipolar transistor Vbe. In accordance with the principles of the invention this nominal voltage is adjusted accordingly.

Turning now to FIG. 8, a representative bandgap circuit is shown in which the output voltage is trimmed to a predetermined level that is consistent from circuit to circuit. The voltage bandgap circuit includes a trimmable resistor network R7 in addition to the trimmable resistor network shown as resistors R4/R5 and R6. The base-emitter voltages Vbe1 and/or Vbe2 are measured at a single predetermined temperature. Based upon the measured base-emitter voltages, the resistor networks R7 and/or R4/R5 are trimmed to provide a predetermined bandgap voltage at the specific temperature. The trimming is determined from table lookup. The table is determined utilizing statistical and empirical methodology.

In accordance with the principles of the invention a method of providing a bandgap circuit, includes forming a bandgap circuit on a substrate 1107 as shown in FIG. 8. The bandgap circuit includes forming a first transistor Q1 and a second transistor Q2 connected in a voltage bandgap circuit arrangement. A differential input amplifier AMP has a first input coupled to the first transistor Q1 and a second input coupled to the second transistor Q2. Amplifier AMP has its output coupled to an output node Vbg. The method includes forming on substrate 1107 a first trimmable resistance network R7 coupled to the bandgap circuit arrangement. As part of the method, an output voltage trimming sequence is performed. The output voltage trimming sequence comprises: measuring a first voltage Vbe1 across two terminals of first transistor Q1 at a single temperature; utilizing Vbe1 to determine a resistance value of first trimmable resistance network R7 and trimming first trimmable resistance network R7 to the resistance value.

In the illustrative embodiment of the invention, the trimming step includes measuring a second voltage Vbe2 across two terminals of second transistor Q2 at the same single temperature. Either Vbe1 or Vbe2 may be utilized to determine the value of resistance network R7.

Subsequent to performing the Vbg voltage trimming sequence to reduce the temperature coefficient, voltage compensating trimming to minimize the absolute value of the output voltage may be performed. The compensating trimming step comprises: trimming said second and third trimmable resistance networks R4/R5 and R6 such that the desired Vref is achieved. Vref will now be of both desired value and a low TC.

The invention has been described in terms of illustrative embodiments. It is not intended that the scope of the invention be limited in any way to the specific embodiments shown and described. It is intended that the invention be limited in scope only by the claims appended hereto, giving such claims the broadest interpretation and scope that they are entitled to under the law. It will be apparent to those skilled in the art that various changes and modifications can be made without departing from the spirit or scope of the invention. It is intended that all such changes and modifications are encompassed in the invention as claimed.

What is claimed is:

1. A voltage bandgap circuit comprising:

a first transistor and a second transistor connected in a voltage bandgap circuit arrangement; a differential input amplifier having a first input coupled to said first transistor and a second input coupled to said second transistor; said amplifier having its output coupled to on output node; and a first trimmable resistance network coupled to said bandgap circuit arrangement, said first trimmable resistance network being trimmable to a resistance level to adjust the output voltage of said bandgap circuit at said output node, said resistance level having a predetermined relationship to a first predetermined voltage measurement made across two terminals of said first transistor at a single temperature; and a single substrate comprising said voltage bandgap circuit arrangement, said differential input amplifier and said first trimmable resistance network.

2. A circuit in accordance with claim 1, wherein:

the area of said first transistor selected to be a predetermined multiple of the area of said second transistor.

3. A circuit in accordance with claim 1, wherein:

said first transistor is a diode connected bipolar transistor, and said second transistor is a diode connected bipolar transistor.

4. A circuit in accordance with claim 3, wherein:

said substrate is processed utilizing CMOS N-well process technology.

5. A method of providing a bandgap circuit, comprising:

forming a bandgap circuit on a substrate, said bandgap circuit comprising a first transistor and a second transistor connected in a voltage bandgap circuit arrangement; a differential input amplifier having a first input coupled to said first node transistor and a second input coupled to said second transistor; said amplifier having its output coupled to an output node;

forming on said substrate a first trimmable resistance network coupled to said bandgap circuit arrangement, performing an output voltage trimming sequence comprising:

measuring a first voltage across two terminals of said first transistor at a single temperature; utilizing said measured first voltage to determine a resistance value of said first trimmable resistance network; and trimming said first trimmable resistance network to said resistance value.

6. A method in accordance with claim 5, comprising:

measuring a second voltage across two terminals of said second transistor at said single temperature; utilizing said second voltage and said first voltage to determine said resistance value.

7. A method in accordance with claim 6, comprising:

forming said first and said second transistors as diode connected bipolar PNP transistors.

8. A method in accordance with claim 7, comprising:

processing said substrate utilizing CMOS N-well process technology.

9. A method in accordance with claim 6, comprising:

trimming said first trimmable resistance network to said resistance value.

10. A method in accordance with claim 9, comprising:

utilizing said first and said second measured voltages to determine said resistance value from a table.

11. A method in accordance with claim 5, comprising:

utilizing said first measured voltage to determine said resistance value from a table.

* * * * *

UNITED STATES PATENT AND TRADEMARK OFFICE

CERTIFICATE OF CORRECTION

PATENT NO. : 7,482,797 B2
APPLICATION NO. : 11/446567
DATED : January 27, 2009
INVENTOR(S) : David Cave It is certified that error appears in the above-identified patent and that said Letters Patent is hereby corrected as shown below:

At column 4, line 55, in Claim 1, please delete "on" and insert --an--, therefor.

Signed and Sealed this

Twenty-third Day of June, 2009

JOHN DOLL
*Acting Director of the United States Patent and Trademark Office*